US005230610A

United States Patent [19]

Reichenmiller

[11] Patent Number: 5,230,610

[45] Date of Patent: Jul. 27, 1993

[54] AXIAL PISTON PUMP

[75] Inventor: Michael Reichenmiller, Waldstetten, Fed. Rep. of Germany

[73] Assignee: Zahnradfabrik Friedrichshafen AG, Fed. Rep. of Germany

[21] Appl. No.: 502,044

[22] Filed: Mar. 30, 1990

[30] Foreign Application Priority Data

Apr. 5, 1989 [DE] Fed. Rep. of Germany ..... 3910915

[51] Int. Cl.[5] ..... F04B 27/08

[52] U.S. Cl. ..... 417/269; 91/499

[58] Field of Search ..... 417/269; 91/499, 501; 92/71

[56] References Cited

U.S. PATENT DOCUMENTS

| | | | |
|---|---|---|---|
| 2,445,281 | 7/1948 | Rystrom | 91/499 |
| 3,384,028 | 5/1968 | Thoma | 91/501 |
| 3,386,389 | 6/1968 | Thoma | 91/501 |
| 3,437,015 | 4/1969 | Kubilos | 91/499 |
| 3,498,227 | 3/1970 | Kita | 417/269 |
| 3,776,102 | 12/1973 | Katayama | 91/501 |
| 4,201,117 | 5/1980 | Cherner | 91/499 |
| 4,223,594 | 9/1980 | Gherner | 91/499 |
| 5,129,797 | 7/1992 | Kanamaru | 91/71 |

FOREIGN PATENT DOCUMENTS

| | | | |
|---|---|---|---|
| 3727853 | 5/1988 | Fed. Rep. of Germany . | |
| 4029509 | 3/1991 | Fed. Rep. of Germany | 417/269 |

*Primary Examiner*—Richard A. Bertsch
*Assistant Examiner*—Peter Koryinyk
*Attorney, Agent, or Firm*—Davis, Bujold & Streck

[57] ABSTRACT

An axial piston pump for supplying two separate oil circuits including two pistons units (6, 8) of which one is situated upon an external circle and the other upon an internal circle. The external piston unit (6) must be regulatable so that it can feed a hydromotor of a radiator fan. The internal piston unit (8) must supply a level regulation with a constant flow of oil. Accordingly, both piston units (6 and 8) suck oil via separate suction bores (11 and 26). In the suction bore (11) of the external piston unit (6) leading to the swash-plate chamber (4) is inserted an electromagnetically actuable controlling valve (12). In order that the pistons (5) of the external piston unit (6) cannot run dry when the controlling valve (12) is regulated, there branches off from the suction bore (11), upstream of the controlling valve (12), a constant-flow bore (23) which via an annular groove (24) and radial bores (25) supplies a relatively small amount of oil to each piston (5) in the dead-center position thereof. The pistons (7) of the internal piston unit (8) receive the oil via an annular groove (27) branching off from the suction bore (26) and discharging in the cylinder chambers (7A) via radial bores (28). The radial bores (28) are open in the lower dead-center position. In this manner pressurized oil can be fed separately to each piston unit without mutual interference. Pressure channels (13A and 30A) of both piston units (6 and 8) discharge in a common sealing surface (35) of a piston carrier (10). In the annual grooves (14 and 31) of a rear housing part (40) exhaust valves (13 and 30), respectively, are located consisting of a ring plate (33, 34) and a rubber elastic ring (36 or 37) and tightly fitting against the sealing surface (35).

11 Claims, 1 Drawing Sheet

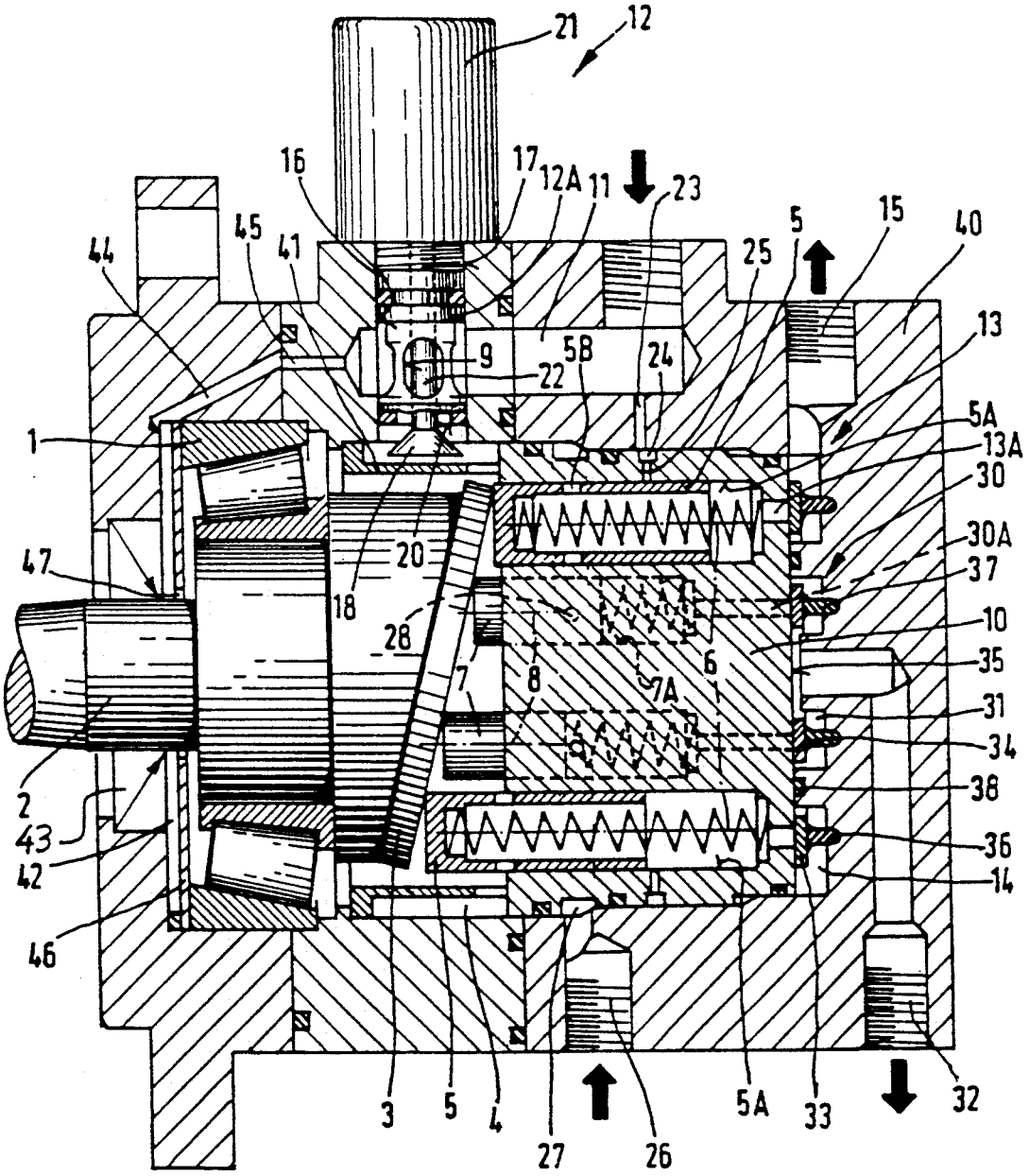
21
12
16
17
12A
11
23
5
15
40
44
45
41
25
13
9
22
5B
24
5A
1
13A
30
30A
47
20
37
18
10
28
35
7
8
6
7A
31
34
2
38
43
36
42
14
46
3
5
4
27
26
5A
33
32

AXIAL PISTON PUMP

The invention concerns an axial piston pump.

BACKGROUND OF THE INVENTION

An axial piston pump having a number of piston units arranged on an external and an internal circle around a swash-plate axle has already been disclosed in DE-OS 3 727 853 (FIG. 6). Upon the external circle act two pistons having a relatively large stroke in pertaining cylinder bores added to a first consumer device, in this case a steering circuit. Upon the internal circle are situated six additional pistons which operate in their cylinder chambers with a smaller stroke and are connected with a second consumer device such as a brake. Both piston units suck the oil from a swash-plate chamber which communicates with a tank via a suction bore. For introducing the pressurized oil in the cylinder chambers, there are provided in the lower dead-center position of the pistons open radial bores connected with the swash-plate chamber via axial bores. In the arrangement known already, it is sought at high speeds to supply the steering circuit with a smaller amount of oil, since at high road speeds less steering aid is required. In this manner, a so-called dropping characteristic line is obtained which is responsible for a strict steering behavior at high road speeds. In order to provide less oil to the external piston unit at high speed, the axial bores of the suction system are in an area of low suction pressure, that is, the axial bores attached to the swash-plate chamber are radially inwardly offset. Since the suction oil in the swash-plate chamber, due to the rotation, assumes a pressure-dependent lamination, the oil is therefore removed from the area which is farthest away from the largest diameter of the rotating element (swash-plate).

On the other hand, the braking circuit is supplied by the internal piston unit through axial bores which are in the area of higher pressure, that is, radially outwardly farther, so that a better piston fill is obtained. In this manner, a single pump can adapt the flow rate need to two consumer devices having different operating requirements. But here the speed-dependent control range, where the external piston unit acts upon the servo-assisted steering system, is relatively narrow. This means that the characteristic line drops only slightly over a wide speed range. Such a characteristic is inadequate, for example, with hydrostatic drives which require a large clamping width of the control flow. Since the piston units of both oil circuits are located in a common swash-plate chamber, a different fill of the individual pistons cannot be entirely avoided, especially in case of high speeds. This is to be attributed to the alternating immersion of the pistons in the swash-plate chamber whereby compressional vibrations originate. Said compressional vibrations are in addition the cause of noises.

SUMMARY OF THE INVENTION

The problem to be solved by the invention is to design an axial piston pump for the supply of two consumer devices independent of each other in a manner such that one piston unit can be operated in a control range as large as possible, that is, between a minimum and a maximum flow. In addition, both piston units must work in each state of operation with a uniform volumetric efficiency. These requirements are met with low cost of construction and only unsubstantially modified dimensions of the pump.

Said problem is solved by the axial piston pump characterized in claim 1. Convenient and advantageous embodiments result from the sub-claims. But the invention is not confined to the combinations of features of the claims. For the expert other possible logical combinations result from the claims and individual features of the claims, as the problem arises.

The solution of the problem mainly consists in that suction bores separated from each other are provided for the oil supply of both piston units and a control valve that determines the oil feed is inserted in the suction bore of one piston unit. Owing to the distributed feed of the pressurized oil it is possible, already in the suction area, to prevent a disadvantageous reciprocal interference of the piston units. In addition, a control flow of larger clamping width is available in the oil circuit of one pump unit. It is possible in this manner, for example, to operate a hydromotor for driving a radiator fan with a control flow of from 0.3 to 10.0 $cm^3$/min, as may be needed. Therefore, the pumping power can be adapted for the cooling need existing at the time.

If the controlling valve is inserted in the suction bore of the external piston unit, then the control flow can be steered directly to the piston feet or inlet openings thereof immersed in the swash-plate chamber. A bore with a constant flow that branches off from the suction bore is also provided upstream of the controlling valve and is attached to the cylinder chambers via a ring groove and radial bores. In this manner, the cylinder chambers can be filled by two different flows, namely, by a control flow and a constant flow. This favors a uniform turbo-charging and a smooth running of the pump. If the controlling valve interrupts the oil flow in the swash-plate chamber, then there is maintained the constant flow which supplies each cylinder chamber with the same small amount of oil. Thereby, a dry operation of the control system can be prevented.

The suction bore of the internal piston unit is attached to a ring groove that communicates via radial bores with the separate cylinder chambers. The oil is supplied in the lower dead center of the pistons in the area of the front end of the pistons. The advantage of this distribution of oil is the independence of the supply of the external piston unit. Since the radial bores departing from the ring groove are situated between the pistons of the external piston unit, the resulting arrangement is space saving and reasonably priced. Via the external piston unit it is possible to take care of a level control, for example.

Evidently it is also possible to supply only one consumer device to eliminate, for example, the internal piston unit in order to operate only one consumer device with one control flow and one constant flow.

Finally, an essential advantage of the invention consists also in that the flow rate of the external piston unit supplied via the controlling valve works independently of the speed, whereas the internal piston unit works depending on the speed. Such a combination of two flow-rate characteristics within one pump housing can be obtained in a simple manner with the controlling valve used and is suitable for operating one consumer device with sharply varying amounts of flow rate and another consumer device with a firmly adjusted characteristic line of flow rate in the presence of a small flow of oil. These properties can be obtained in the narrowest space without using an expensive variable displacement pump.

BRIEF DESCRIPTION OF THE DRAWINGS

Other details of the invention will now be described with reference to the drawing.

FIG. 1 is a diagrammatic cross-sectional view of an axial piston pump for two separate consumer devices according to the present invention.

DETAILED DESCRIPTION OF THE INVENTION

A shaft 2 supported on a bearing 1 carries a swash-plate 3. The swash-plate 3 rotates in a swash-plate chamber 4. A piston unit 6 consisting of several pistons 5 and another piston unit 8 consisting of several pistons 7 are situated on the swash-plate 3 on different planes of rotation. The pistons 5 of the external piston unit 6 are passed into cylinder bores 5A and the pistons 7 of the internal piston unit 8 are passed into the cylinder bores 7A of a piston carrier 10. As soon as the swash-plate 3 rotates, it shifts said pistons 5 and 7 in stroke motions. A suction bore 11 connected with a tank (not shown) leads, via a controlling valve 12, to the swash-plate chamber 4 filled with oil in which the pistons 5 of the external piston unit 6 are immersed with their inlet bores 5B located in an intermediate portion of each of the pistons 5. The pistons 5 press the sucked oil into a common (first) ring (chamber) channel 14 via an (first) exhaust valve 13 which closes pressure channels 13A. Said ring channel 14 is connected via an (first) exhaust bore 15 with a hydromotor that operates a radiator fan.

The controlling valve 12 is lodged in a bore 16 that perpendicularly cuts the suction bore 11 and is screwed on a coil 17. It essentially consists of one valve cone 18, a valve seat 20 and a stem 22 connected with an armature (not shown) of a solenoid 21. But the controlling valve 12 optionally can also be coupled with a hydraulic or mechanical adjusting mechanism. The oil flows through openings 9 into the interior of a sleeve 12A that forms the valve seat 20 and from there, in the area of the valve cone 18, into the swash-plate chamber 4. Via an electronic switch gear (not shown) the controlling valve 12 can be regulated depending on the temperature of the cooling water. According to the temperature signal, the solenoid 21 controls the valve seat 18, 20 more or less to open or close against the spring tension or so as to obtain over the changeable oil flow a fan speed proportional to the temperature of the cooling water.

At a still lower temperature of the cooling water, the valve seat 18, 20 is closed. In order that no dry operation of the piston unit 6 can occur until the cooling water is sufficiently heated, a second possible supply must be additionally provided. For this purpose, a constant-flow bore 23, which discharges in annular groove 24 branches off from the suction bore 11 before the controlling valve 12. Radial bores 25 lead from said annular groove 24 to an intermediate portion of each cylinder bore 5A of the piston unit 6. Therefore, in the lower dead center of the pistons 5 it is possible to inject a small amount of oil enough for a sufficient lubrication of the pump and of the hydromotor. When the controlling valve 12 is open, the small amount of constant flow combines with the larger flow of oil sucked from the swash-plate chamber 4 in the cylinder chambers 5A. When the controlling valve 12 is closed, the radial bores additionally ensure a uniform partial filling of the cylinder bores 7A so that the pressure pulsation and therewith the noise diminish.

The internal piston unit 8 has a suction bore 26 and supplies the level control. By separating the suction bores 11 and 26, it is possible at all times to maintain the oil supply of the level control independently of the state of operation of the hydromotor. The suction bore 26 discharges in a ring channel 27 from which radial bores 28 branch off to an intermediate portion of the cylinder chambers 7A of the pistons 7. If the pistons 7 are arranged on their circle offset with respect to the external piston 5, there remains between the latter piston 5 (sic) sufficient space for working the radial bores 28 into the piston carrier 11. The radial bores 28 are allowed to discharge in the lower dead-center position of the pistons 7, above the front surface thereof, in the cylinder chambers 7A. The cylinder chambers 7A communicate with pressure channels 30A, all covered by an (second) exhaust valve 30. The exhaust valve 30 opens into a (second) ring chamber 31 connected with an (second) exhaust bore 32 attached to the level control. Both exhaust valves 13, 30 for the piston unit 6 or 8 have the same structure and with a ring plate 33 or 34 fit tightly against a common sealing surface 35 of the piston carrier 10. A rubber elastic ring 36, 37 supported in a rear housing part 40 holds in contact the ring plate 33 or 34. During the pressure stroke of the pistons 5, 7, the ring plate 33 or 34 retracts, in the area of the pertaining pressure channel 13A or 30A, in part sufficiently away from the sealing surface 35 so that the pressurized oil can flow out into the ring channel 14 or 31 and toward the pertaining consumer devices. Both piston units 6 and 8 are reciprocally sealed by an O-ring 38. The arrangement described of the exhaust valves 13 and 30 has the advantage that the sealing surface 35 can be simultaneously processed for both oil circuits on the piston carrier 10. Besides, the annular grooves 14 and 31, the same as the pertaining exhaust channels, can all be worked into the rear housing part 40.

The constant-flow bore 23 can be advantageously selected of a size such that the amount of penetration suffices to allow the hydromotor to run at its basic speed. By virtue of this step the controlling valve 12 can close sooner and must not remain in a floating position in the state of operation of the hydromotor.

By means of a cylindrical baffle plate 41 inserted in the swash-plate chamber 4 concentrically in respect to the swash-plate 3, it is possible to guide the oil flowing out from the controlling valve 12 in the direction of the inlet bores 5B of the external piston unit 6. Said step effects a good turbo-charging of the pistons 5.

Since a vacuum can originate in the swash-plate oil supply chamber 4 owing to the suction side control, a chamber 42 on the rear side of the bearing 1 must be released of pressure due to the shaft packing ring 43 existing there. For this reason the chamber 42 is advantageously connected with the suction bore 11 by bores 44 and 45. There is also provided a pressure-relief ring 46 which, via a throttle point 47, lets through enough oil for lubricating the bearing.

I claim:

1. An axial piston pump comprising a rotatable swash-plate, located within a swash-plate chamber and defining a central swash-plate axis, actuating a plurality of pistons, each of said plurality of pistons being located within an associated piston cylinder bore which is arranged in one of an external circle and an internal circle around the swash-plate axis, and each said piston being biased axially away from a base of the associated piston cylinder bore by biasing means;

said swash-plate chamber communicating with suction bore means for supplying oil thereto from an oil supply;

each of said plurality of pistons allowing flow, during use, of pressurized oil into said associated piston cylinder bore, via at least one inlet radial bore formed in an intermediate portion of one of said piston and said associated piston cylinder bore, when said piston is based sufficiently axially away from the base of said associated piston cylinder bore by said spring means;

said plurality of pistons situated in said external circle, during use, conveying oil to a first consumer device via a first exhaust valve;

said plurality of pistons situated in said internal circle, during use, conveying a lesser amount of oil to a second consumer device via a second exhaust valve;

wherein said suction bore means comprises two separate suction bores (11 or 26) for supplying oil to said external piston circle and said internal piston circle (6, 8), and each of said two suction bores (11 or 26) communicating with one of said external piston circle and said internal piston circle (6, 8); and a controlling valve (12), for regulating the supply of oil, is inserted in said suction bore (11) of one of said external and internal piston circles (6).

2. An axial piston pump according to claim 1, wherein said control valve (12) is located in said suction bore (11) of said external piston circle (6); and a constant-flow bore (23), branching off from said suction bore (11) of said external piston circle upstream of said control valve (12), directly communicates with said piston cylinder bores (5A) of said external piston circle (6) so that a flow division into a variable controlled flow and a constant controlled flow takes place in said suction bore of said external piston circle.

3. An axial piston pump according to claim 2, wherein said external piston circle (6) supplies a hydromotor with a variable oil flow rate and said internal piston circle (8) supplies a level control with an substantially lesser oil flow rate.

4. An axial piston pump according to claim 2, wherein said at least one inlet radial bore is formed in an intermediate portion of each said piston in said external piston circle (6) and said variable controlled oil flow flows from said swash-plate chamber (4) via each said at least one inlet radial bore (5B) into said associated piston cylinder bore (5A); and said constant-flow bore (23) communicates with an annular groove (24) which communicates with further radial bores (25) communicating with said piston cylinder bores (5A) of said external piston circle (6) at a location adjacent the base of each said piston cylinder bore.

5. An axial piston pump according to claim 4, wherein a cylindrical baffle plate (41) is inserted in said swash-plate chamber (4), said cylindrical baffle plate (41) is concentric with respect to said swash-plate (3) and guides the flow of oil from said control valve (12) into each said at least one inlet radial bore of said pistons in said external piston circle (6).

6. An axial piston pump according to claim 2, wherein each said at least one inlet radial bore is formed in an intermediate portion of each said piston cylinder bore in said internal piston circle (8), and said suction bore (26) of said internal piston circle (8) communicates with an annular groove (27) which communicates with each said at least one inlet radial bore (28) formed in said piston cylinder bores (7A) in said internal piston circle (8).

7. An axial piston pump according to claim 2, wherein said first and second exhaust valves (13, 30) of said external and said internal piston circles (6, 8) engage tightly against a common sealing surface (35); and annular sealing members (33, 34) with rubber elastic compression rings (36 or 37) are provided as said first and second exhaust valves (13, 30).

8. An axial piston pump according to claim 7, wherein said first and second exhaust valves (13, 30) are located within respective first and second annular chambers (14 or 31) which communicate with first and second exhaust bores (15, 32), respectively, and said first and second annular chambers and said first and second exhaust bores (15, 32) are formed in a housing cover (40).

9. An axial piston pump according to claim 2, wherein said control valve (12) is located in said suction bore (11) of said external piston circle (6) and is operated by a solenoid (21).

10. An axial piston pump according to claim 2, wherein an oil supply chamber (42) is situated between a bearing (1) of said swash-plate and a shaft packing (43) of said swash-plate, and said oil supply chamber communicates with said suction bore of said external piston circle (6) via at least one bore (44, 45); and a relief ring (46) that forms a throttle point (47) is located within said oil supply chamber (42).

11. An axial piston pump according to claim 2, wherein said constant-flow bore (23) is sized of a desired cross sectional area so that, when said control valve (12) is closed, the hydromotor is adjusted by said constant-flow bore (23) to a basic operating speed.

* * * * *